United States Patent [19]

Shapiro

[11] Patent Number: 4,768,522

[45] **Date of Patent: * Sep. 6, 1988**

[54] DEVICE FOR EXERCISING VAGINAL MUSCLES

[75] Inventor: Seymour W. Shapiro, Lowell, Ind.

[73] Assignee: Exta, Inc., Gary, Ind.

[ * ] Notice: The portion of the term of this patent subsequent to Mar. 31, 2004 has been disclaimed.

[21] Appl. No.: 17,815

[22] Filed: Feb. 24, 1987

[51] Int. Cl.[4] ..... A61B 5/00

[52] U.S. Cl. ..... 128/778; 128/79; 272/93

[58] Field of Search ..... 272/93, 119, 135; 128/778, 344, 25 R, 79; 604/96; 73/379

[56] References Cited

U.S. PATENT DOCUMENTS

| | | | |
|---|---|---|---|
| 1,735,519 | 11/1929 | Vance | 128/79 X |
| 2,507,858 | 5/1950 | Kegal | 128/778 |
| 2,541,520 | 2/1951 | Kegal | 128/778 |
| 3,081,634 | 3/1963 | Blaszkowski | 73/379 |
| 3,495,589 | 2/1970 | Clement | 128/79 |
| 3,598,106 | 8/1971 | Buning | 128/778 |
| 3,640,282 | 2/1972 | Kamen et al. | 128/351 |
| 3,726,273 | 4/1973 | Cole | 128/79 X |
| 3,799,173 | 3/1974 | Kamen | 128/351 |
| 4,048,985 | 9/1977 | Sasse | 128/778 |
| 4,050,449 | 9/1977 | Castellana et al. | 128/778 |
| 4,106,489 | 8/1978 | Martin | 272/137 |
| 4,140,119 | 2/1979 | Pollack | 604/96 X |
| 4,167,938 | 9/1979 | Remih | 128/778 |
| 4,216,783 | 8/1980 | Kaiser et al. | 128/778 |
| 4,327,709 | 5/1982 | Hanson et al. | 604/96 X |
| 4,653,514 | 3/1987 | Shapiro | 128/778 |

*Primary Examiner*—Richard J. Apley
*Assistant Examiner*—David J. Bender
*Attorney, Agent, or Firm*—Emrich & Dithmar

[57] ABSTRACT

An improved device for use in exercising vaginal muscles, embodying a cuffed rod for insertion into the vagina, the cuff being normally yieldingly inflated for affording a yielding resistive force, while being collapsible to the diameter of the rod.

10 Claims, 1 Drawing Sheet

DEVICE FOR EXERCISING VAGINAL MUSCLES

BACKGROUND OF THE INVENTION

This invention relates to devices for exercising vaginal muscles.

The present invention is related to co-pending U.S. application Ser. No. 615,052, filed May 29, 1984, now issued as U.S. Pat. No. 4,653,514, which in turn was a continuation application of U.S. application Ser. No. 219,241, filed Dec. 22, 1980, now abandoned, filed in the name of the present inventor and assigned to the same assignee.

The object of the present invention is to afford a novel device for use in exercising vaginal muscles.

Another object is to afford a novel device of the aforementioned type which may be readily and easily inserted into a vagina.

A further object is to afford a novel device of the aforementioned type, the parts of which are constituted and arranged in a novel and expeditous manner effective to protect the female against injury during insertion thereof into the vagina and during use thereof in the exercising of the vaginal muscles.

Weakness of the muscles of the pelvic floor is common among the adult female population, and, particularly among those women who have borne children. Advanced degrees of weakness of these muscles culminate in loss of support of the bladder, urethra, rectum and uterus.

Exercise is a well established means of obtaining and maintaining muscle fitness. Exercises may be classified into passive, active and resistive categories. Resistive exercises require the use of muscles against a force which, commonly, is relatively small at the beginning of an exercise program and gradually increases as the muscle tone and strength increase.

The pelvic floor muscles support the vaginal walls. It is an important object of the present invention to afford a novel device for use in resistive exercising of these muscles.

Another object of the present invention is to afford a novel exercise device of the aforementioned type, which, when inserted into position of use in a vagina, exerts a soft, yielding minimal pressure or force against the vaginal walls, which force increases as the vaginal muscles are exercised and contract.

A further object of the present invention is to afford a novel exercise device of the aforementioned type, wherein the parts thereof are so constituted and arranged that, in use, the female using the device is able to recognize the degree of muscle activity being exerted by her own sensations.

Another object of the present invention is to afford a novel device of the aforementioned type, which, if desired, may embody a measuring device for indicating the amount of muscle contraction taking place during exercise by measurement of the volume of air displaced from the device.

A still further object of the present invention is to afford a novel exercise device of the aforementioned type which is practical and efficient in opertion, and which may readily and economically produced commercially.

Other and further objects of the present invention will become apparent from the following description and claims and are illustrated in the accompanying drawings which, by way of illustration, show a preferred embodiment of the present invention and the principles thereof and what I now consider to be the best mode in which I have contemplated applying these principles.

Another object of the present invention is to afford a novel device of the aforementioned type wherein the resistive force thereof increases with increases in the tone and strength of the muscles.

Exercise devices for insertion into the vagina have been heretofore known in the art, being shown, for example, in U.S. Pat. Nos. 2,507,858, issued to Arnold Kegal; 2,541,520, issued to Arnold Kegal; 3,598,106, issued to Eric Bumning; 3,726,273, issued to Ned S. Cole; 4,048,985, issued to Howard A. Sasse; 4,050,449, issued to Frank S. Castellana, et al; 4,106,489, issued to Kenneth W. Martin; and 4,216,783, issued to Howard Kaiser.

Exercise devices of the aforementioned type, which have been heretofore known in the art, have commonly had several inherent disadvantages, such as, for example, being difficult to insert into the vagina; being painful to insert into the vagina or being painful in use during exercising of the vaginal muscles; being so constituted and arranged as to create danger of injury to the vagina during insertion thereinto and/or during use therein; or creating a maximum initial pressure against the vaginal walls, which, in the use thereof, can be the cause of injury or damage to such walls, and the like and also because the compositions of such devices are latex or rubber, such materials being irritating to human tissue and difficult to clean and maintain for repetitive use. Thus, these prior art devices do not permit true resistive exercising which is a most important factor in their usage and these prior art devices do not include an inert material in their constructions. Also, such prior art devices do not permit the user to accurately self measure progress in building muscle strength by measuring the displaced volume of air because they are a closed system. In the present invention, when in use, the vaginal exercise device is open to the atmosphere to thereby permit the measurement of displaced volume of air or air flow from within the cuff portion of the exercise device. Finally, the prior art devices are bulky in appearance which discourages their use. The advantage of the present invention is that it permits the sponge to be compressed (or sucked down) into the recessed area of the rod—this decreases the bulkiness of the device during either insertion or withdrawal from the vagina. It is an important object of the present invention to overcome such disadvantages of the prior art devices.

The present invention is related to co-pending application U.S. Ser. No. 615,052, filed May 29, 1984, now U.S. Pat. No. 4,653,514 which in turn was a continuation application of U.S. Ser. No. 219,241, filed Dec. 22, 1980, now abandoned filed in the name of the present inventor and assigned to the same assignee.

Other embodiments of the invention embodying the same or equivalent principles may be used and structural changes may be made as desired by those skilled in the art without departing from the present invention and the purview of the appended claims.

DETAILED DESCRIPTION

Figures 1, 2, 3, 4:
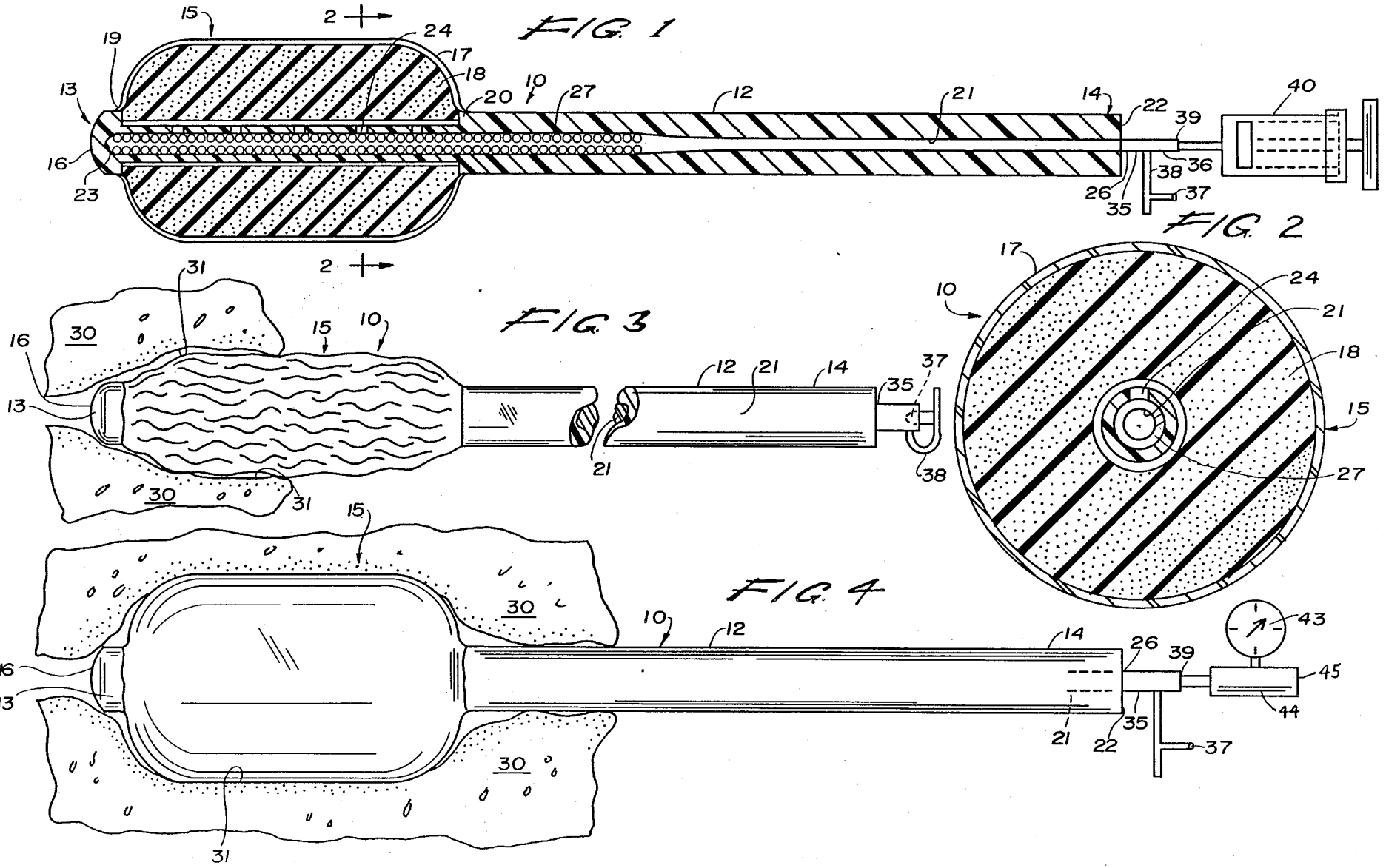
FIG. 1 is a fragmentary, side elevational view of a device embodying the principles of the present invention, to illustrate the presently preferred embodiment of the present invention, and showing the device connected to a vacuum means or syringe.
FIG. 2 is a detail sectional view taken substantially along the line 2—2 in FIG. 1.
FIG. 3 is a view, showing the device being inserted into a vagina under a vacuum.
FIG. 4 is a view similar to FIG. 2, but showing the device inserted into the vagina and in operable position relative thereto and showing the device attached to air flow measuring means.

An exercising device 10, embodying the principles of the present invention, is shown in the drawings which illustrate the preferred embodiment of the present invention.

The exercising device 10 embodies, in general, an elongated rod 12 having a distal end portion 13 and a proximal end portion 14, with a cuff portion 15 mounted on the distal end portion 13, FIGS. 1–4.

The rod 12, preferably, is semi-rigid and flexible-pliable in construction, and may be made of several suitable materials, for example, medical grade silicone which does not react with human tissue. As will be discussed in greater detail, in the use of the exercise device 10, the distal end portion 13 of the rod 12, bearing the cuff 15, is inserted into the vagina (FIGS. 3 and 4), the proximal end portion 14 of the device 10 affording a member 14 by which the device 10 may be manually retained in such position in the vagina. Free end 16 of the distal end portion 13 is preferably rounded to facilitate insertion of the device 10 into the vagina, and as protection against injury to the vagina during insertion and during the time the device is retained therein.

The cuff portion 15 mounted on the distal end portion 13 includes a substantially air impervious medical grade silicone cover 17 and a body portion 18 disposed within the cover 17. Both the cover 17 and the body portion 18 are disposed around the distal end portion 13 of the rod 12, preferably in spaced relation to the end 16 thereof, as shown in FIGS. 1 and 2.

The cover 17 is flexible and it is preferably made of medical grade silicone or the like. Preferably also, it is elastic for reasons which will hereinafter be discussed in greater detail.

The cover 17 is tubular in form, and the end portions 19 and 20 thereof are hermetically sealed to the outer surface of the rod 12 by suitable means, such as, for example, being vulcanized thereto or affixed by a suitable medical grade cement such as silicone cement, or the like.

The body or sponge portion 18 provides a resilient mass which fills the cover 17 between the end portions 19 and 20 thereof and, when the exercise device is disposed in normal inoperative position outside the vagina, the sponge portion 18 is preferably effective in yieldingly holding the cover 17 in fully expanded position, as shown in FIGS. 1 and 2. The body or sponge portion 18 may be made of any suitable resilient material, but, preferably, is made of several grades or densities of a sponge-like resilient material having a multitude of interstices therein, such as, for example, sponge-type silicone or a suitable resilient plastic material, such as, for example, foamed polyurethane, or the like, for a purpose which will be discussed in greater detail presently.

From the foregoing it will be seen that the cuff portion 15 of the exercise device 10 is similar in construction to the cuffs embodies in the tracheal tubes disclosed in U.S. Pat. Nos. 3,640,282 and 3,799,173, issued to Jack M. Kamen.

An elongated passageway 21 extends longitudinally through the rod 12 from a free end 22 of the proximal end portion 14 thereof into the interior of the cuff 15, terminating at an inner end 23 in inwardly spaced relation to the free end 16 of the distal end portion 13. Passageways 24 extend radially outwardly from the passageway 21, through the side wall of rod 12 and open outwardly into the interior of the cuff 15 for the purpose which will hereinafter be described.

As shown in FIG. 1, the rod 12, in the area where the cuff portion 15 is mounted, has a decreased-in-diameter or stepped portion 25. Such a recessed or stepped portion 25 is provided so that the body 18 and cover 17 of the cuff portion 15, when collapsed, will have a diameter which is substantially equal to the outer diameter of rod 12. This results in and permits for ease of insertion of the device 10 into a vagina 30, as will hereinafter be described.

Further, to provide support for the stepped portion 25 of the rod 12, a reinforcing means or spring member 27 is positioned in the passageway 21 and extends substantially from the distal end 23 of the passageway 21 toward the proximal end 14 of tube 12 and ends at a position approximately midway along the length of the tube 12. However, it is within the scope of the present invention that the reinforcing means 27 may include any type of reinforcement member, such as, a metal sheath of wire-type member that is flexible but possesses a memory in that it will return to a substantially linear configuration.

An adapter 35, embodying an elongated tubular body member 36 is mounted in the proximal end portion 14 of the rod 12, with one end portion of the body member 36 disposed in the passageway 21, FIGS. 1, 3 and 4. The adapter 35 includes a plug 37, attached to the body portion 36 by a flexible strap means 38, the plug 37 being movable on the strap means 38 between a position wherein it is disposed in the free end portion 39 of the body portion 36 of the adapter 35 to thereby close the passageway 21 and the body portion 36 to the atmosphere, as shown in FIG. 3, to a position wherein the plug 37 is disposed out of the adapter 35, as shown in FIGS. 1 and 4.

With the exercise device 10 constructed in the aforementioned manner, when it is desired to insert the device 10 into a vagina 30, diagrammatically shown in FIGS. 3 and 4, a partial vacuum may be applied to the free end 22 of the rod 12 by any suitable means, such as, for example, a vacuum syringe 40, to thereby cause the cuff portion 15 to move from its normal expanded position, shown in FIGS. 1 and 4, to a totally collapsed position wherein the cuff and cover are positioned within the recessed portion 25 of the rod 12, as shown in FIG. 3. In the collapsed position, the diameter of the collapsed cuff 15 and cover 17 is substantially the same as the outer diameter of the rod 12. After the cuff portion 15 and cover 17 have been collapsed, the passageway or opening 26 on free end 22, which communicates with passageway 21 is sealed or closed. This may be done by using an adapter 35 which is engaged into opening 26 to seal the passageways 21 and 24 of the rod 12 and the interior of the cuff 15. The closure may be of any suitable means, such as, for example, by pinching the tubular body member 36 of adapter 35 to close the adapter, then withdrawing the vacuum syringe 40 therefrom and immediately closing the end position 39 of the member 36 by a finger or other means. However, it is preferred that the end 39 of adapter 35 be closed by inserting the plug 37 into end 39. This is effective in retaining a partial vacuum in the cuff 15 to retain it in the collapsed position, as shown in FIG. 3.

While maintaining the on the cuff 15 in a collapsed position, the distal end portion 13 and the cuff 15 is inserted into a vagina 30, (FIG. 3), the collapsed position of the cuff 15 facilitating such insertion. Preferably, the insertion of the device is such that the cuff 15 is disposed in position within the sphincter type muscles in the vaginal area. Thereafter, when the device 10 has been moved into the desired position in the vagina 30, the partial vacuum in the cuff 15 is released by removing the plug 37 from end 39 to thereby permit the cover 17 to be pushed and expanded outwardly by the expansion of the resilient sponge body member 18. The expansion of the cover 17 is from the collapsed position to an expanded position wherein it is yieldingly positioned to retain the body portion 18 in engagement with an inner wall 31 of the vagina 30 (FIG. 4). Such expansion is caused by the resiliency of the sponge body portion 18 and is a direct result of the volumetric expansion thereof and provides an exercise device the interior of the cuff which is in direct communication with the atmosphere. Importantly, the density of the sponge body portion 18 may be varied to provide different grades or amounts of yielding pressure gradients within each exercise device 10. This is to be distinguished from the expansion of the aforementioned cuffs on exercise devices heretofore known in the art, which cuffs are expanded by the application of a positive pressure, by the introduction of air or other working fluid thereinto under pressure. Such prior devices, therefore, start with the largest force upon initial contact with the vaginal muscles.

The cover 17 of the cuff 15 may be made of any suitable flexible material, but preferable is medical grade silicone. When so constructed, the cover comprised of medical grade silicone is so constructed that the wrinkles that are formed therein when in the collapsed position, as shown in FIG. 3, are soft and minimize abrasive tendencies with the vaginal lining or muscles. Whereas with some materials which are flexible but do not possess softness and which are abrasive, such as, for example, certain plastic or rubber sheet materials, and the like, wrinkles could be formed when the cover 17 is disposed in a position wherein it was extended outwardly less than that which it occupies when in fully extended position. In the present invention, it is not essential as to whether or not the cover 17 is wrinkled when the cuff 5 is in its fully collapsed position, FIG. 3, and it is not essential nor an absolute requirement, when the cuff 15 is disposed in operative engagement with the walls of the vagina 31, such as is shown in FIG. 4, that the cover 17 be wrinkle free. However, it is preferred that the cover 17 be structured and sized to substantially envelope the sponge portion 18, when the cuff 15 is in operative engagement with the vagina lining 31, as shown in FIG. 4. Therefore, to insure against abrasive wrinkles, I prefer that the cover 17 be made of a suitable material such as medical grade silicone.

With device 10 disposed in operative position against the vagina 31, the female may contract her pelvic floor muscles against the urging of the body portion 18 of the cuff 15. This, it will be seen, is a gentle, yielding urging, which, unlike the urging of the fluids used to inflate cuffs of exercise devices heretofore known in the art with a positive pressure, does not exert a positive pressure against the side walls or lining 31 of the vagina 30, which positive pressure is in danger of injuring delicate membranes such as the sidewalls of the vagina 30. Instead, the present invention begins with a minimal resistive force which increases as contraction increases.

It is important to note that the use of the device 10, in pelvic floor muscle exercise, provides not only a resistive exercise for such muscles, but also provides progressively increasing resistance as the body portion 18 of the cuff 15 continues to be compressed. Thus, it will be seen that the device 10 is capable of exerting a small minimal resistive force at the beginning of an exercise program, when the muscular tone and strength is relatively weak, while affording a gradually increasing resistive force as the muscular tone and strength increases. Also, with this increasing compression of the body portion 18 of the cuff 15, the female using the device 10 is able to recognize the increasing resistance by her own sensations, and realize that the exercises are being effective in building up the tone and strength of her pelvic floor muscles.

At the completion of the exercises, the device 10 is manually removed from the vagina 30. Preferably, prior to such removal, a vacuum is again applied to the cuff 15 in the aforementioned manner, to thereby dispose the cuff 15 in a totally collapsed position, as shown in FIG. 3, to facilitate removal of the device 10.

Although the rod 12 is shown in FIGS. 1, 3 and 4, of the drawings as embodying the passageway 21 as an integral part or interior of the rod, but it will be appreciated by those skilled in the art that this is merely by way of illustration of the preferred embodiment of the present invention, and not by way of limitation, and that other passageways may be afforded without departing from the purview of the broader aspects of the present invention.

Also, it will be seen that, with the device 10 constituted and arranged in the aforementioned manner, if it is desired to do so, an air flow measuring means 43 may be associated therewith for measuring the performance of the female in contracting her pelvic floor muscles, rather than the aforementioned reliance on her own sensations as to the increasing compression of the body portion 18. For example, a volume displacement or air flow measuring means 43, may be secured to the portion 39 of the adapter 35 mounted to the end 22 of the rod 12, the means 43 being capable of measuring the air flow from within the cuff 15 and the passageway 11 caused by the contraction of the vaginal muscles of the female, greater contraction, of course, causing higher air flow. The measuring means 43 permits the air flow from within the cuff 15 to escape the open end 45 of the tubular connector 44 which mounts the measuring means 43 to the adapter 35. If desired, the user of the device 10 can even place a finger adjacent to the opening 26 in free end 2 of rod 12, which opening and physically feel and sense the air flow upon contraction of the vaginal muscles.

From the foregoing it will be seen that the present invention affords a novel exercise device 10 for use in exercising the vaginal muscles.

In addition, it will be seen that the present invention affords a novel device of the aforementioned type which is practical and efficient in operation, and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A device for exercising the vaginal muscles comprising
   a. An elongated rod having
      (1) a closed distal end portion for insertion into the vagina of a female, and
      (2) a proximal end portion for manually retaining said distal end portion in said vagina,
   b. a cuff mounted on said distal end portion
   c. said cuff comprising
      (1) a flexible tubular cover
         (a) disposed on said elongated rod in surrounding relation thereto, and
         (b) having its ends secured to the outer surface of said rod, and
      (2) a resilient body portion mounted in said cover,
   d. said body portion having normally an expanded position, wherein it is effective to hold a portion of said cover outwardly away from said rod under atmospheric conditions,
   e. means operatively connected to said cover said means comprising a passageway extending longitudinally of said elongated rod from said proximal end and communicating with said cover to permit the passage of air therethrough for
      (1) creating a vacuum therein and thereby move said cover inwardly from said expanded position to a collapsed position for movement of said distal end portion and said cuff into said vagina, and
      (2) releasing such a vacuum in said cover to thereby permit said cover to move outwardly toward said expanded position under urging of said body portion into position to
         (a) yieldingly engage the walls of such portion and said cuff are disposed, and
         (b) to be collapsed inwardly by said walls, against the urging of said body portion, upon contraction of the vaginal muscles by said female;
   f. said elongated rod having a recessed diameter portion which is surrounded by said flexible tubular cover and said resilient body portion of said cuff for receiving said resilient body portion and said cover therein when the vacuum moves the cover and urges said body portion to a collapsed position, and
   g. said passageway in said elongated rod having a reinforcing means positioned and held in said proximal portion of said passageway.

2. A device in accordance with claim 1, wherein said reinforcing means is a spring member.

3. A device in accordance with claim 1, and in which
   a. said means connected to said cover comprises a passageway extending longitudinally within said rod from said proximal end into said cover for passage of air therethrough during said creation and release of said vacuum.

4. A device in accordance with claim 3, and in which
   a. said body portion has interstices spread therethrough.

5. A device in accordance with claim 1, and in which
   a. said body portion comprises a sponge-like elastic mass mounted in said cover for yieldingly urging the latter outwardly.

6. A device in accordance with claim 5, and in which
   a. said elastic mass comprises polyurethane foam rubber, and
   b. said cover comprises medical grade silicone.

7. A device in accordance with claim 1, and which includes
   a. means for closing said passageway after creating a vacuum on said cover whereby said cover is moved to said collapsed position for thereby holding said vacuum in said cover during insertion of said distal end portion and said cuff into said vagina.

8. A device in accordance with claim 7, and in which
   a. said means for closing said passageway comprises a plug attached to said proximal end and movable into and out of said passageway.

9. A device in accordance with claim 1 and which includes
   a. a volume displacement indicator means connected to said passageway for measuring the air flow escaping from said cuff when said cover is collapsed by said contraction of said vaginal muscles.

10. A device in accordance with claim 1, and in which said rod is flexible and pliable.

* * * * *